United States Patent [19]

Hisey et al.

[11] Patent Number: 4,974,686

[45] Date of Patent: Dec. 4, 1990

[54] APPARATUS FOR HANDLING A DRILLING EQUIPMENT

[75] Inventors: Robert W. Hisey, Rowlett; James R. Mayer, Victoria, both of Tex.

[73] Assignee: Oy Tampella AB, Tampere, Finland

[21] Appl. No.: 374,360

[22] Filed: Jun. 30, 1989

[51] Int. Cl.[5] ..... E21B 3/00

[52] U.S. Cl. ..... 173/164; 166/77.5

[58] Field of Search ..... 173/164, 163; 175/52, 175/85; 166/77.5

[56] References Cited

U.S. PATENT DOCUMENTS

| | | | |
|---|---|---|---|
| 3,920,087 | 11/1975 | Hisey | 173/164 |
| 4,128,135 | 12/1978 | Mitchhart et al. | 173/164 X |
| 4,403,666 | 9/1983 | . | |
| 4,813,493 | 3/1989 | Shaw et al. | 173/164 |

FOREIGN PATENT DOCUMENTS 3521923 1/1986 Fed. Rep. of Germany .

*Primary Examiner*—Frank T. Yost
*Assistant Examiner*—Willmon Fridie, Jr.
*Attorney, Agent, or Firm*—Ladas & Parry

[57] ABSTRACT

An apparatus for mechanically handling drilling equipment comprising at least drill pipes and a drill bit and drill guide bushing has a carrier. A clamp on the carrier clamps a first drill pipe unrotatably relative to the carrier in a drill-pipe position. An opener is spaced from the clamping axially of the first drill pipe when the first drill pipe is clamped in the drill-pipe position, the opener being pivoted on a first pivot that is spaced from and parallel to the first drill pipe when the first drill pipe is clamped in the drill-pipe for pivoting to an opener position at a second drill pipe that is axially thread-connected onto the first drill pipe and withdrawal therefrom. A first power device so pivots the opener. An opening member is pivoted on the opener for pivoting to an opening-member position at the second drill pipe to connect the opening member to the second drill pipe unrotatably relative to the second drill pipe and rotate the second drill pipe, whereby to open the thread connection of the first and second drill pipes, and withdrawal therefrom. A second power device so pivots the opening member. A second pivot on the carrier is spaced from and parallel to the first pivot and a resilient element pivotally supports the first pivot from the second pivot for resiliently limiting the pivoting of the first pivot about the second pivot, whereby the latter pivoting permits arcuate positioning of the opening means.

7 Claims, 4 Drawing Sheets

APPARATUS FOR HANDLING A DRILLING EQUIPMENT

Figure 1:
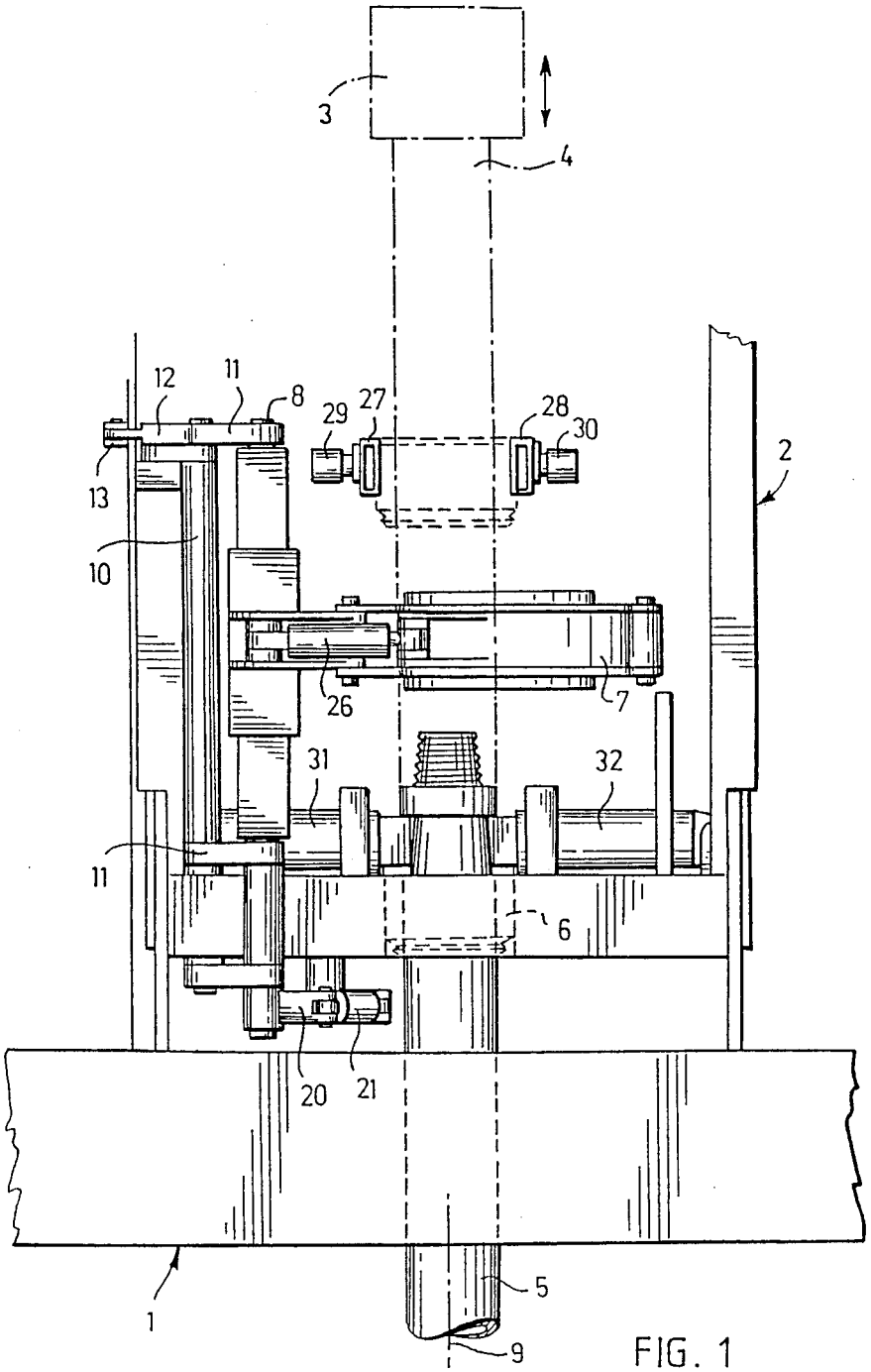

The invention relates to an apparatus for mechanically handling drilling equipment comprising at least drill pipes and a drill bits and drill guide bushing.

Particularly when drilling large holes in ground and rock, the handling of the drilling equipment is very difficult due to its large size and high weight. It is very often necessary for one reason or another to disassemble a drill rod formed by a number of successive drill pipes interconnected by threads that are difficult to open. The drill bit at the end of the drill rod wears down rapidly in hard rock and has to be replaced with a new one even daily, whereby the whole drill rod has to be disassembled for replacement. Similarly, the guidebushing attached to the drill carrier is subject to wear during drilling so that it has to be replaced.

When disassembling a drill rod, it is lifted upwards together with the rotation motor until the second drill pipe counted from the rotation motor reaches the drill carrier. Thereafter the drill pipe is gripped by a clamp jaw or the like attached to the drill carrier for preventing it from rotating and, after the topmost drill pipe has been released, for preventing it from falling into the drill hole. The drill pipe closest to the rotation motor is then rotated in one way or another with respect to the lower drill pipe so as to open the thread and release the pipe.

Threads are usually opened by means of a separate device opening device (hereafter means) suspended from a drill rig by a wire rope. The opening means is handled manually. However, this procedure is very heavy and difficult and often too slow. If the thread between the drill pipe closest to the motor and an adjacent drill pipe opens first, the thread closest to the motor thereby has to be opened while the opening means are supported on some point and the motor is rotated in a direction opposite to the direction of drilling. In an attempt to open threads, the motor is often switched on several times in succession to rotate it in a direction opposite to the direction of drilling. In such a case, any one of the threads to be opened may open first, whereby the one which has not opened has to be opened by means of the opening means. Similarly, if the threads are very tight, the motor may burn as a result of successive attempts so that the entire motor has to be changed, which results in an expensive shutdown.

U.S. Patent Specification No. 4 403 666 discloses a mechanical solution in which two opening tools arranged to be pushed around the drill pipe along a line going through the center of the drill pipe are secured to the drill carrier. Both these opening tools can be locked around the drill pipe and one of them can be rotated about the central axis of the drill pipe for loosening the joint. This solution avoids the problem connected with the loosening of the joint whereas it does not solve the other problems connected with the handling and loosening of the drilling equipment.

U.S. Pat. No. 3,920,087 discloses a solution in which a platelike disc rotatable about the drill pipe is mounted in the carrier of the drilling equipment. Further, a retainer provided with a telescopic arm is mounted in the carrier pivotably about a vertical axis, the retainer being arranged to be pivoted so as to surround the drill pipe. An upper pipe is kept in place by means of the retainer while a lower pipe is rotated by means of a rotating means so as to open the thread of the pipe. In the apparatus of the U.S. Patent, it is difficult to get the jaws of the retainer in the right position, because projections in the jaws have to be positioned at corresponding points in the pipe. Further, after the thread has been opened, the pipe cannot be immediately loosened completely, because the opening device below does not keep the pipe in place in the vertical direction, so that it does not prevent the rest of the pipe from falling into the drill hole.

When replacing a drill bit, the threaded joint between it and a drill pipe has to be loosened similarly as a joint between drill pipes. For this purpose, the drill bit has to be lifted above the drill carrier and after the guide bushing guiding the drill rod has been lifted up from its place together with the drill bit, it has to be replaced with a so called basket used as an aid when detaching the drill bit. The basket itself can be mounted unrotatably relative to the carrier. Inside the basket there are provided projections which fit in between the edges of the drill bit, thus preventing the rotation of the drill bit in the basket. In this way, the drill bit is maintained stationary while the thread is being opened. After the drill bit has been detached from the drill rod, it is removed and replaced with a new drill bit which in screwed on the drill rod, whereafter the drilling process is continued as usually.

When detaching the drill bit, the guide bushing positioned above it has to be lifted away in order that the drill bit could be replaced. This causes extra trouble during replacement, since the guide bushing has to be kept in the lifted position. The size and weight of a drill bit intended for large holes are such that two persons are required for lifting it. Thus the handling of the drill bit is extremely difficult. The basket and the guide bushing are also very heavy and difficult to handle. In addition, a common drawback of the prior art is that the operator has to carry out the required measures manually, which is heavy and risky and delays unnecessarily the drilling process, because the disassembly of one drill rod may require as much as a couple of hours when using the prior art techniques.

The object of the present invention is to provide an apparatus for handling a drilling equipment in such a way that the operator of the drilling apparatus can alone take care of the handling of the whole drilling equipment, the disassembly of a drill rod in a normal drilling situation, and the replacement of a drill bit and guide bushing in a remote-controlled manner. In the invention, this is achieved by mounting the opening means pivotably about a vertical pivot axle spaced from the drilling axis relative to the carrier so that the opening means are arranged to be displaced to the position for opening the drill pipe and to be withdrawn therefrom by pivoting it about said pivot axle, the apparatus further comprising means for pivoting the opening means about the pivot axle.

The basic idea of the invention is that the opening means used for disassembling a drill rod are mounted so as to be pivotable relative to the drill carrier about a vertical axis preferably along an arched path so that in a normal case it is positioned about the normal vertical axis of the drill rod and that the pivot axle is mounted flexibly relative to the drill carrier so that the opening means can be placed around the drill rod even though the position of the drill rod would not be such as supposed. Furthermore, the basic idea of the invention implies that the opening means are mounted vertically displaceably relative to the vertical axis thereof so that they can be lifted and lowered as required. An advantage of the apparatus according to the invention is that irrespective of the position of the drill rod as compared with the supposed position, the flexible attachment of the vertical axle makes it possible to place the opening means around the rod. A further advantage of the invention is that the opening means can be used both for opening threads and displacing the drill bit and the basket thereof for mounting the drill bit on a rod, and for removal and replacement of a worn drill bit. Still another advantage of the invention is that the entire process can be effected by remote control from the control panel of the equipment without any manual work and without the operator having to move from one place to another.

Figure 2:
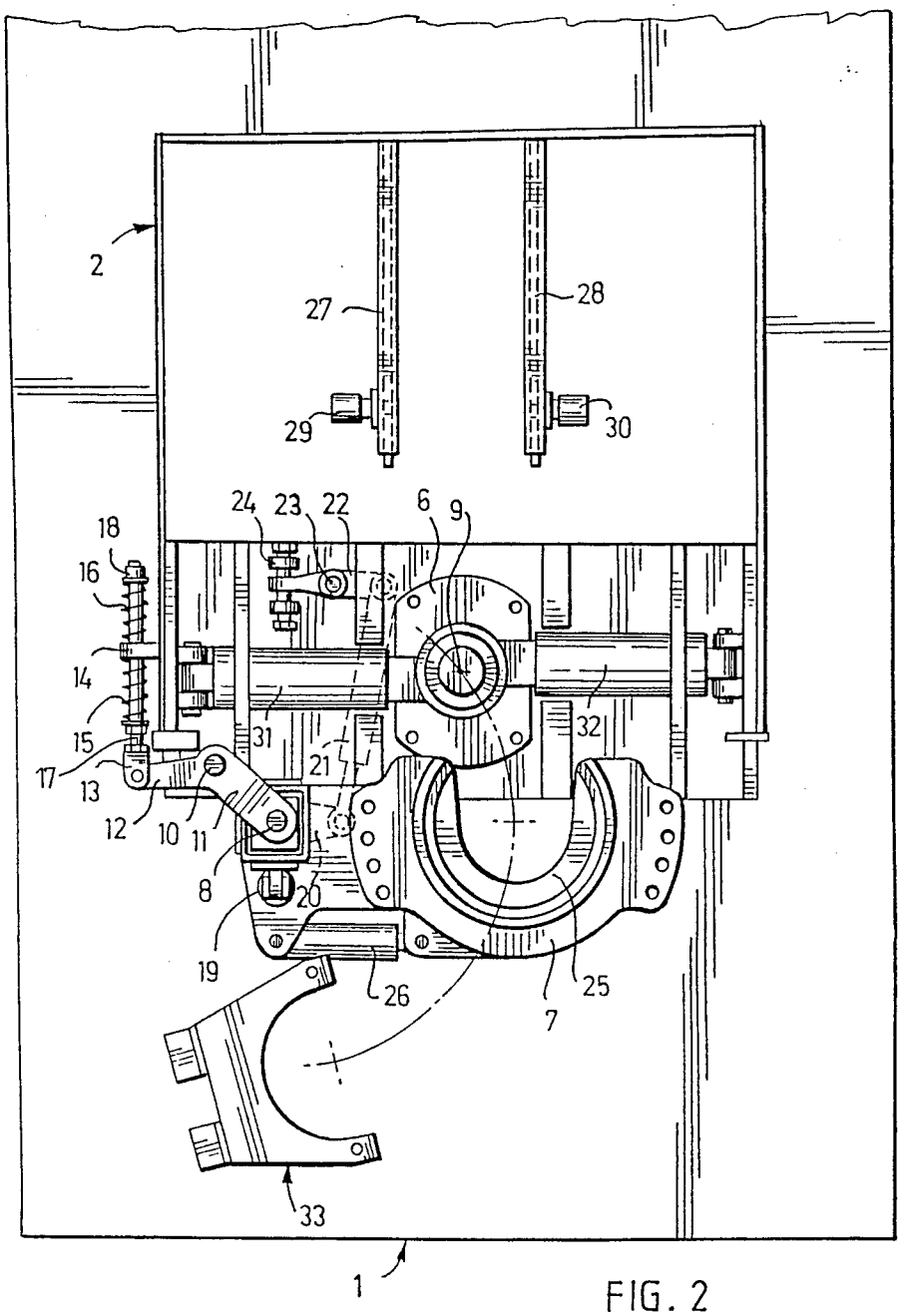
Figure 3A:
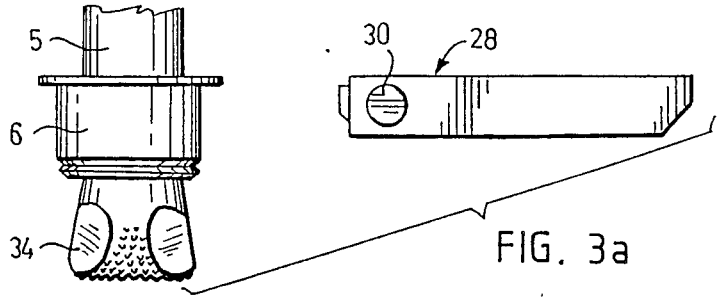
Figure 3B:
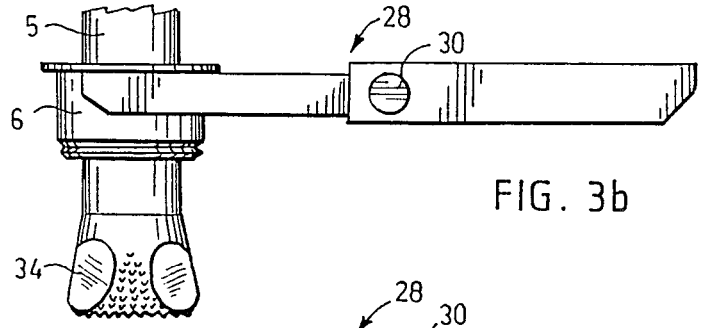
Figure 5A:
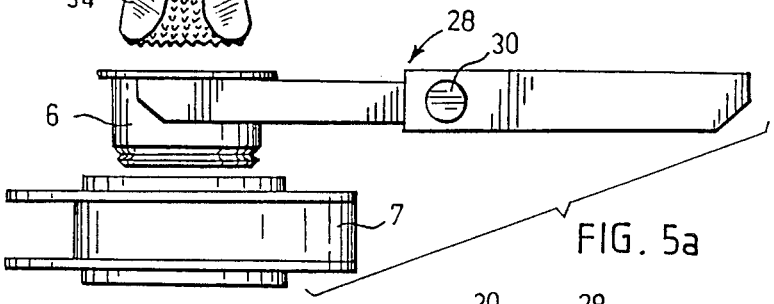
Figure 5B:
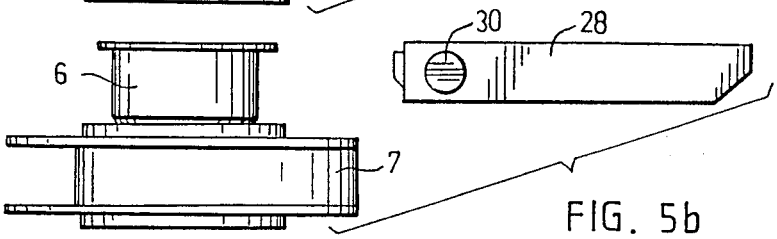
Figure 5C:
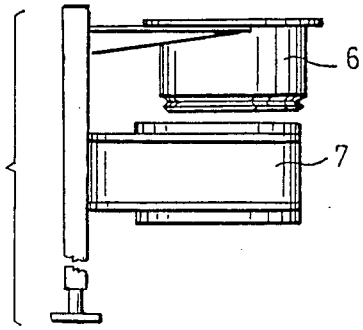
Figure 4A:
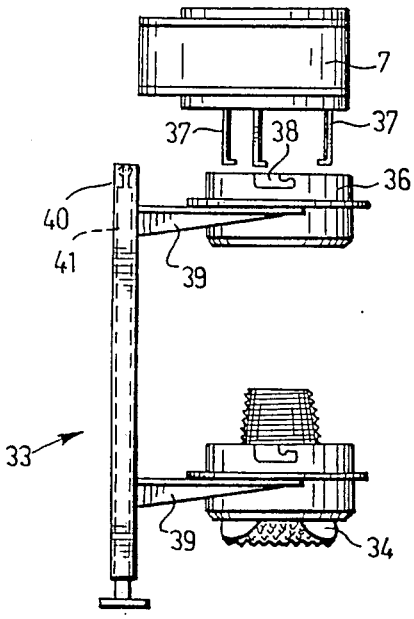
Figure 4C:
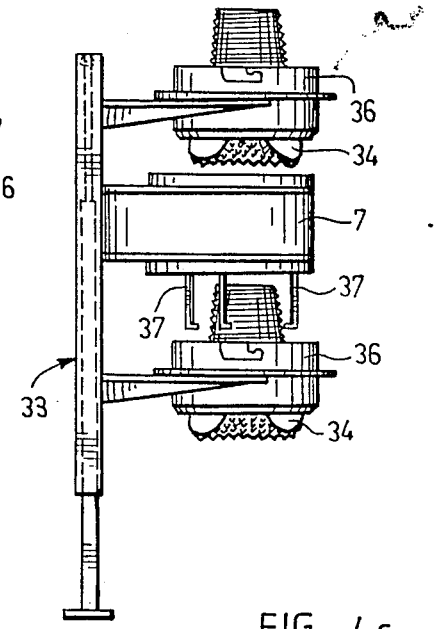
Figure 4B:
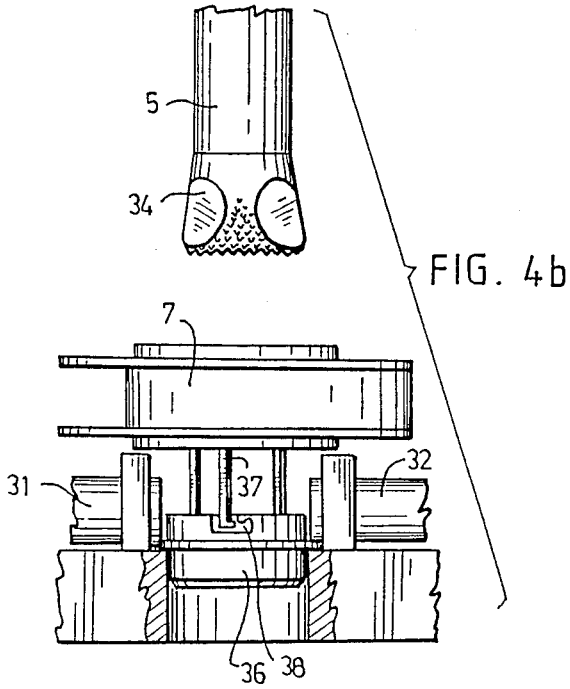

The invention will be described in more detail with reference to the following drawings, wherein FIG. 1 is a schematical front view of an apparatus according to the invention;

FIG. 2 is a top view of the apparatus according to the invention of FIG. 1;

FIGS. 3*a* and 3*b* are side elevations of a portion of the apparatus of FIG. 2 in respective operating positions that illustrate stages for placing a guide bushing on supports;

FIGS. 4*a* to 4*c* one side elevations of further portions of the apparatus of FIG. 2 in respective operating positions that illustrate stages for placing a basket and a drill bit positioned therein on a support rack and taking a new basket and drill bit therefrom; and FIGS. 5*a* and 5*b* to 5*c* are side elevations of portions of the apparatus of FIGS. 3*a*, 3*b* and 4*a*to 4*c* in respective operating positions that illustrate stages for taking a guide bushing from the support and displacing it on to the rack, and for taking a new guide bushing from the rack and displacing it on to the support.

FIG. 1 shows a drill rig 2 positioned on a drill carrier 1. A motor 3 is arranged to move along the rig in a manner which known per se and which therefore is not described. A drill rod 4 formed by successive drill pipes 5 is connected to the motor 3 with a thread. The drill pipes are interconnected in a manner known per se with threads. The drill rod 4 passes through a guide bushing 6 mounted in the carrier. FIG. 1 further shows opening means 7 for opening the joints between the drill pipes 5 and between the lowest drill pipe 5 and a drill bit (34 in FIG. 3*a*) attached thereto. The opening means 7 are connected to the carrier pivotably about a vertical axle 8 so that when it is pivoted about an auxiliary shaft 10 spaced from the central axis of the drill pipes of the drill rod, i.e., the drilling axis 9, along an arched path, it is placed around the drilling axis 9. The pivot axle 8 is connected to the vertical auxiliary shaft 10 by means of lever arms 11 pivotable thereabout. One end of one, upper lever arm 11 is further connected pivotably by means of another lever arm 12 to a bar 13 which is inserted through a hole in a lug 14 (FIG. 2) provided in the frame so that facing ends of springs 15 (FIG. 2) and 16 (FIG. 2) surrounding the bar are positioned on opposite sides of the lug 14. The opposite ends of the springs engage nuts 17 and 18 (FIG. 2), respectively, on the bar, thus allowing the bar to move in the longitudinal direction resiliently under a load that may act thereon, whereby the pivot axle 8 may pivot away from its normal position along an arched pivot line to an extent determined by the nuts 17 and 18.

The opening means 7 are mounted vertically displaceably, i.e. parallel to the pivot axle 8, so that its vertical position can be adjusted by means of a cylinder 19 (FIG. 2) that is also in parallel with the axle 8. For pivoting the opening means 7 on the axle 8, a power device 21 is connected to the axle by means of a lever 20. The power device, in turn, is connected pivotably relative to the carrier about a shaft 23 by means of a lever 22. The lever 22 can be adjusted to a desired position by means of adjusting screws 24 on opposite sides thereof. By adjusting said adjusting screws the axle 8 can be rotated so that the opening means 7 will be positioned accurately around the supposed drilling axis 9.

Inside the opening means 7 there is provided a pivot member 25, i.e., a jaw member that can be pivoted clockwise and anti-clockwise by means of a power device 26 acting between it and the opening means. FIGS. 1 and 2 further show supports 27 and 28 for the guide bushing 6. The supports comprise bars acting as supporting means and displaceable by means of motors 29 and 30 connected thereto.

On disassembling the drill rod 4, the joint between the drilling machine or motor 3 and the first drill pipe 5 is opened first, so that the drilling machine 3 can be totally detached from the pipe. Before the drilling machine 3 has been totally detached, the drill rod 4 is lifted sufficiently for the drill pipe 5 next to the drilling machine 3 to be inserted and clamped between the jaws of lower clamps 31 and 32 mounted in the carrier and acting as retainers. Thereafter, the opening means 7 are pivoted so as to surround the upper drill pipe, and by turning the jaw member 25 by means of the power device 26, the thread between the upper drill pipe 5 and the lower drill pipe 5 is loosened, whereafter the drill pipe is unscrewed and set aside. The drilling machine 3 is again lowered down and screwed on the drill pipe 5 clamped between the jaws 31 and 32. Thereafter the jaws are released, the drill rod 4 is again lifted up, and the same loosening process is repeated until the lowest drill pipe 5 attached to the drill bit 34 in FIG. 3*a* is positioned next to the drilling machine. FIGS. 3*ak* and 3*b* illustrate the subsequent stage at which the guide bushing 6 supported by the drill bit 34 is lifted up so that the supports 27 and 28 of the guide bushing can be displaced by means of motors 29 and 30 below the guide bushing for supporting it. Thereafter the drill pipe 5 and the drill bit 34 are lowered down so that the guide bushing 6 rests on the supports 27 and 28.

The opening means comprise bars 37 fastened to the jaw 25. Said bars act as supports and comprise pins or hooks to be inserted into peripheral grooves 38 provided in the basket through groove openings reaching up to the upper edge of the basket. When the opening means 7 are pivoted above an empty basket 36 positioned on a rack 33, the bars 37 are aligned with the openings of the grooves 38. When the opening means 7 are then lowered or the basket is 36 lifted by means of a lifting device 41 provided in the rack, the lifting hooks 37 are inserted into the grooves 38 and, by turning the jaw 25 acting as an opening member, displaced within the grooves away from the openings. Thereafter, correspondingly, the basket is detached from the rack either by lifting the opening means 7 or by lowering the supports 39 of the rack 33. By pivoting the opening means 7 about the pivot axle 8 and by lifting the same, the basket is then displaced above the hole of the guide bushing 6, whereafter the opening means 7 are lowered so that so the basket is lowered into the hole. Further, by pivoting the jaw 25 of the opening means 7, the lifting hooks 37 are displaced to a point in which they can be removed from the grooves 38 by lifting the opening means 7, and the opening means 7 are pivoted aside.

Thereafter the drill pipe 5 and the drill bit 34 are lowered down into the basket 36, inside which there are provided projections which fit in between the edges of the drill bit 34 so as to prevent the rotation of the drill bit relative to the basket 36. This structure is known per se and obvious to one skilled in the art, so it will not be described more closely herein.

Thereafter the opening means 7 grips the drill pipe 5 as described above, and the pipe is screwed off the drill bit 34. Again the opening means 7 are lowered down above the basket 36 and fastened in the grooves 38 of the basket 36 by means of the lifting hooks 37 and the drill bit 34 is lifted together with the basket 36 up from the hole of the guide bushing 6 and is displaced on to the rack 33 by pivoting the opening means 7 about the axle 8, and placed thereon. Thereafter the opening means 7 are pivoted aside from above the rack and the supports 39 of the rack are lifted up by means of the power device 41 until the opening means 7 can be pivoted below the upper drill bit 34 and further to grip the supporting basket 36 of the lower drill bit 34, whereafter the basket 36 with the drill bit is displaced as described above into the hole of the guide bushing 6 for mounting the drill pipe 5 therein and for continuing the drilling process.

If it is necessary to replace the guide bushing 6, the drill bit 34 has to be removed first as described above. Thereafter the opening means 7 are displaced so as to surround the drill pipe 5 and lifted upwards until the guide bushing 6 is lifted off the supports 27 and 28. The supports 27 and 28 are then retracted and the opening means 7, on which the guide bushing 6 rests, are lowered and pivoted again about the axle 8 towards the rack 33 so that a support shelf 39 remains under the flange of the guide bushing. Thereafter the rack 33 is lifted upwards, whereby the removed guide bushing 6 remains on the shelf and the opening means 7 can be pivoted first outside the shelf and then displaced below a lower new guide bushing 6, whereafter the new guide bushing 6 can be displaced on to the supports 27 and 28 in a reverse order as compared with the above.

Thereafter a new drill bit 34 is displaced as described above; the drill pipe 5 is screwed thereon; the drill bit 34 is lifted up from the basket 36, which is removed in a reverse manner as compared with the above. Thereafter the guide bushing 6 can again be lowered into the drill hole and the drilling process can be continued.

The description and the drawings related thereto only describe one preferred embodiment of the invention known to the Applicant and the invention is by no means restricted thereto. The supports 37 attached to the opening means as well as the supporting means in the basket 36 may be of various kinds and shapes. The supports of the guide bushing may be of any suitable structure known per se and in addition to being longitudinally displaceable they may be pivotable about a vertical or horizontal axis as well. The rack 33 can be constructed in various different ways. The opening means 7 can be provided with shafts and attached resiliently in various ways. Similarly, the opening means 7 may be constructed in any way meeting the operational requirements set by the invention. In cases where a stabilizer is provided after the drill bit for use during drilling, additional phases are required in the replacement of the drill bit and the guide bushing, which are obvious on the basis of the above and thus do not in any way restrict the scope of protection defined by the claims.

We claim:

1. An apparatus for mechanically handling drilling equipment comprising at least drill pipes, a drill bit and a drill guide bushing, the apparatus comprising:

a carrier;

clamping means on the carrier for clamping a first drill pipe unrotatably relative to the carrier in a drilling position;

opening means spaced from the clamping means axially of the first drill pipe when the first drill pipe is clamped in the drilling position, the opening means being pivoted on a first pivot that is spaced from and parallel to the first drill pipe when the first drill pipe is clamped in the drilling position, and being for pivoting to an opening position at a second drill pipe that is axially thread-connected onto the first drill pipe;

first power means for so pivoting the opening means;

an operating member mounted rotatably on the opening means so as to connect the opening member to the second drill pipe unrotatably relative to the second drill pipe and to rotate the second drill pipe to open the thread connection of the first and second drill pipes;

second power means for so rotating the opening member;

a second pivot on the carrier spaced from and parallel to the first pivot; and resilient-element means pivotally supporting the first pivot from the second pivot for resiliently limiting the pivoting of the first pivot about the second pivot, whereby the latter pivoting permits arcuate positioning of the opening means.

2. An apparatus according to claim 1, and further comprising:

spacing means for varying the spacing of the clamping means and opening means, whereby to permit the opening means to support a drill bit or drill guide bushing; and connecting means on the opening means for connecting to a drill bit, whereby to support the same.

3. An apparatus according to claim 2, wherein the connecting means comprise a supporting basket which supports the drill bit while it is positioned in the storage rack as well as during the displacement of the bit, the supporting basket comprising supporting means, and the connecting means comprising supports mounted on the underside of the opening means and being connectable to the supporting means of the supporting basket.

4. An apparatus according to claim 3, wherein the supports in the opening means are mounted in the opening member and arranged to extend to the supporting means by lowering the opening means above the basket, the supports being connectable to the supporting means and detachable therefrom by pivoting the opening member about the opening axis thereof.

5. An apparatus according to claim 4, wherein the supporting means are peripheral grooves provided on the outer periphery of the supporting basket, the grooves comprising a vertical opening extending up to the upper surface of the basket, and wherein the supports are formed by a vertical rod provided for each groove, each rod comprising a support pin to be inserted to the opening of the respective groove, said opening member being displaceable by pivoting away from the opening to a point where the groove is intact.

6. An apparatus according to claim 2, comprising means for supporting the drill guide bushing in alignment with the drilling axis so that the opening means are pivotable below the drill guide bushing to the opening position, the drill guide bushing, while supported by the supporting means, being displaceable to be supported by the opening means by lifting the opening means in the opening position upwards, whereby the drill guide bushing is displaceable between the drilling axis and the storage rack while supported by the opening means, and arranged to be positioned on the supports of the storage rack by lowering the opening means.

7. An apparatus according to claim 6, wherein the supporting means comprise at least two supporting rods which are displaceable under the flange of the drill guide bushing to the supporting position for supporting the guide bushing and correspondingly removable from the supporting position, and means for displacing the supporting rods.

* * * * *